US010826216B2

(12) United States Patent
Zebhauser et al.

(10) Patent No.: US 10,826,216 B2
(45) Date of Patent: Nov. 3, 2020

(54) OUTER CONDUCTOR ARRANGEMENT FOR A COAXIAL PLUG CONNECTOR

(71) Applicant: Rosenberger Hochfrequenztechnik GmbH & Co. KG, Fridolfing (DE)

(72) Inventors: Martin Zebhauser, Laufen (DE); Christian Anfang, Bergen (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 0 days.

(21) Appl. No.: 16/699,445

(22) Filed: Nov. 29, 2019

(65) Prior Publication Data

US 2020/0099154 A1 Mar. 26, 2020

Related U.S. Application Data

(63) Continuation of application No. 16/079,234, filed as application No. PCT/EP2016/000338 on Feb. 26, 2016, now Pat. No. 10,541,488.

(51) Int. Cl.
*H01R 24/40* (2011.01)
*H01R 13/05* (2006.01)
(Continued)

(52) U.S. Cl.
CPC ..... *H01R 13/052* (2013.01); *H01R 9/0518* (2013.01); *H01R 13/6582* (2013.01);
(Continued)

(58) Field of Classification Search
CPC ..... H01R 13/052; H01R 9/0518; H01R 13/6582; H01R 24/44; H01R 24/40; H01R 2103/00
See application file for complete search history.

(56) References Cited

U.S. PATENT DOCUMENTS 4,461,531 A * 7/1984 Davis ..... H01R 43/26 439/843
4,493,527 A * 1/1985 Piscitelli ..... H01R 13/111 439/852
(Continued)

FOREIGN PATENT DOCUMENTS

CN 101512846 A 8/2009
CN 104380532 A 2/2015
(Continued)

OTHER PUBLICATIONS

Machine Translation of JP2002208461A.
(Continued)

*Primary Examiner* — Truc T Nguyen
(74) *Attorney, Agent, or Firm* — David P. Dickerson

(57) ABSTRACT

The invention relates to an outer conductor arrangement (4) for a coaxial connector (2). According to the invention, the outer conductor arrangement (4) is of two-part design, comprising a contact component (6) for electrical and mechanical connection to an outer conductor of a mating connector and comprising a connection component (8*b*) for electrical and mechanical connection to an outer conductor of a coaxial cable, wherein the contact component (6) and the connection component (8*b*) are electrically and mechanically connected to one another at a contact section (12*b*), wherein a compensation section (26) for compensation of a component difference in the region of the contact section (12*b*) is arranged between the contact component (6) and the connection component (8*b*).

18 Claims, 6 Drawing Sheets

(51) Int. Cl.

| | |
|---|---|
| ***H01R 9/05*** | (2006.01) |
| ***H01R 13/6582*** | (2011.01) |
| ***H01R 24/44*** | (2011.01) |
| *H01R 103/00* | (2006.01) |

(52) U.S. Cl.
CPC ..... *H01R 24/40* (2013.01); *H01R 24/44* (2013.01); *H01R 2103/00* (2013.01)

(56) References Cited

U.S. PATENT DOCUMENTS

| | | | | |
|---|---|---|---|---|
| 5,217,391 | A | 6/1993 | Fisher, Jr. | |
| 5,720,634 | A * | 2/1998 | Sten | H01R 13/111 439/843 |
| 5,897,404 | A * | 4/1999 | Goodman | H01R 13/187 439/843 |
| 5,975,964 | A * | 11/1999 | Seko | H01R 13/18 439/857 |
| 6,042,432 | A * | 3/2000 | Hashizawa | H01R 13/187 439/843 |
| 6,254,439 | B1 * | 7/2001 | Endo | H01R 13/187 439/843 |
| 9,515,403 | B2 * | 12/2016 | Hirakawa | H01R 13/187 |
| 9,917,390 | B1 * | 3/2018 | Bianca | H01R 13/187 |
| 2002/0187686 | A1 * | 12/2002 | Zhao | H01R 11/22 439/843 |
| 2003/0162447 | A1 * | 8/2003 | Beloritsky | H01R 13/187 439/843 |
| 2004/0003498 | A1 * | 1/2004 | Swearingen | H01R 13/187 29/862 |
| 2006/0089058 | A1 * | 4/2006 | Derleth | H01R 13/187 439/877 |
| 2006/0101900 | A1 * | 5/2006 | Nishio | G01N 27/407 73/31.05 |
| 2007/0249225 | A1 * | 10/2007 | Sakaguchi | H01R 9/0518 439/578 |
| 2009/0298356 | A1 * | 12/2009 | Li | H01R 43/16 439/843 |
| 2010/0178801 | A1 | 7/2010 | Miyashita et al. | |
| 2011/0059648 | A1 * | 3/2011 | Montena | H01R 9/05 439/578 |
| 2012/0135625 | A1 | 5/2012 | Yokoyama et al. | |
| 2015/0099397 | A1 | 4/2015 | Listing et al. | |
| 2016/0020528 | A1 * | 1/2016 | Miyakawa | H01R 13/111 439/870 |
| 2016/0134032 | A1 * | 5/2016 | Hall | H01R 43/0207 439/578 |

FOREIGN PATENT DOCUMENTS

| | | | |
|---|---|---|---|
| CN | 103490200 | B | 7/2015 |
| DE | 3412874 | C1 | 8/1985 |
| DE | 10315042 | A1 | 10/2003 |
| EP | 1378971 | A1 | 1/2004 |
| JP | H0424287 | U | 2/1992 |
| JP | 2002208461 | A | 7/2002 |

OTHER PUBLICATIONS

Machine Translation of JPH0424287U (JP 平4-24287 U).
Machine Translation of CN103490200A.

* cited by examiner

OUTER CONDUCTOR ARRANGEMENT FOR A COAXIAL PLUG CONNECTOR

FIELD OF THE INVENTION

The invention relates, inter cilia, to an outer conductor arrangement for a coaxial connector.

BACKGROUND OF THE INVENTION

Coaxial connectors serve to releasably connect coaxial cables. Coaxial connectors are of coaxial design like coaxial cables, and they therefore have the advantages of coaxial cables, specifically low electromagnetic influencing and irradiation and also good electrical shielding and also an impedance that corresponds to that of the connected coaxial cable in order to avoid reflection phenomena at the transition point between the coaxial connector and the coaxial cable. In this case, a coaxial cable, also called coax cable for short, is understood to mean a two-pole cable of concentric design that has an inner conductor (also called core) that is surrounded by a hollow-cylindrical outer conductor at a constant distance. The outer conductor shields the inner conductor against electromagnetic interference radiation. An insulator or dielectric is arranged in the intermediate space between the inner conductor and the outer conductor.

Coaxial connectors are designed to provide a predetermined characteristic impedance, for example of 50Ω, in order to ensure reflection-free transmission of RF signals. The characteristic impedance of a coaxial connector depends, amongst other things, on the ratio of the inside diameter of the outer conductor and the diameter of the inner conductor. Therefore, electrical connection of a coaxial cable to a coaxial connector requires coaxial connectors that are matched to the respective inside diameter and outside diameter of the coaxial cable. However, this increases production and logistics costs, for example in the manufacture of prefabricated cable harnesses, since a multiplicity of different coaxial connectors have to be kept available for different coaxial cables. Coaxial connectors of this kind also have to satisfy different requirements in order on the one hand to establish good electrical contact and on the other hand to ensure sufficient mechanical stability. This leads to high production costs during manufacture of coaxial connectors of this kind.

If an outer conductor arrangement for a coaxial connector has a contact component for connection to a mating piece of the coaxial connector comprising a connection component for linking of an outer conductor of a coaxial cable, connection components for linking of outer conductors of a coaxial cable with different diameters have, however, adjusted outside dimensions. For example, a connection component for linking of an outer conductor having a first diameter has an outside diameter that is smaller than the outside diameter of a second outer conductor having a second, larger diameter. However, since the contact component is configured, for example, for connection to a connection component for linking of an outer conductor having a large diameter, when an outer conductor having a small diameter is linked to a corresponding connection component, good electrical and/or mechanical contact with the contact component is not provided.

BRIEF SUMMARY OF THE INVENTION

The invention is based on the object of showing a way of being able to improve the contact quality independently of the diameter of the outer conductor.

This object is addressed by the embodiments recited in the independent claims. Further embodiments are recited in the dependent claims.

To this end, in the case of an outer conductor arrangement for a coaxial connector, there is provision for the outer conductor arrangement to be of two-part design, comprising a contact component for electrical and mechanical connection to an outer conductor of a mating connector and comprising a connection component for electrical and mechanical connection to an outer conductor of a coaxial cable, wherein the contact component and the connection component are electrically and mechanically connected to one another at a contact section, wherein a compensation section for compensation of a component difference in the region of the contact section is arranged between the contact component and the connection component.

This has the advantage that differences in the outside dimensions of different connection components for coaxial cables having different diameters can be compensated by the compensation section and a consistent contact quality is thus ensured independently of the inner conductor and outer conductor diameter of a coaxial cable that is to be linked.

According to one embodiment, the compensation section is associated with the connection component. The contact quality can thus be increased by adjusting only the connection component or selecting a suitable connection component from a plurality of connection components for different diameters of outer conductors.

According to a further embodiment, the compensation section is formed by a folded material section of the connection component. The connection component is thus formed integrally with the compensation section and can be produced in a particularly simple manner.

According to a further embodiment, the folded material section is embossed at least in sections. Through prior embossing of the material section, it is thus possible to provide said material section with a reduced material thickness in sections so that the folded material section can have a material thickness between the material thickness of the folded material section and the doubled material thickness.

According to a further embodiment, the contact component has a contact section having an outside diameter and the connection component has an inside diameter, wherein the compensation section compensates for the component difference formed by the difference between the outside diameter of the contact section and the inside diameter of the connection component. The compensation section is thus configured for compensation of diameter differences of two components that are to be connected and has a particularly simple design.

According to a further embodiment, the compensation section is produced from brass or an alloy containing brass, from tin bronze or an alloy containing tin bronze, from zinc or an alloy containing zinc, or from stainless steel or an alloy containing stainless steel. In this case, brass (CuZn) is understood here to mean copper alloys whose main constituents are the metals copper (Cu) and zinc (Zn), whereas tin bronze (CuSn) is understood to mean alloys comprising at least 60 percent copper (Cu), provided they are not to be assigned to the brasses owing to the main alloy additive of zinc (Zn) but comprise tin (Sn) as main alloy additive. Stainless steel is understood here to mean a group of corrosion-resistant and acid-resistant steel grades, for example with the material numbers 1.4571 or 1.4404.

According to a further embodiment, the connection component and the compensation section are produced from the same material. The connection component and the compensation section can thus be of single-material design and are therefore particularly resistant to corrosion.

The invention also includes a contact component and a connection component for an outer conductor arrangement of this kind, a plug for a coaxial connector of this kind comprising an outer conductor arrangement of this kind, a coaxial connector having an outer conductor arrangement of this kind, and a construction kit for forming a coaxial connector of this kind.

BRIEF DESCRIPTION OF THE DRAWINGS

The invention will be explained in more detail in the following text on the basis of the drawing. In said drawing

DETAILED DESCRIPTION OF THE INVENTION

Figure 1:
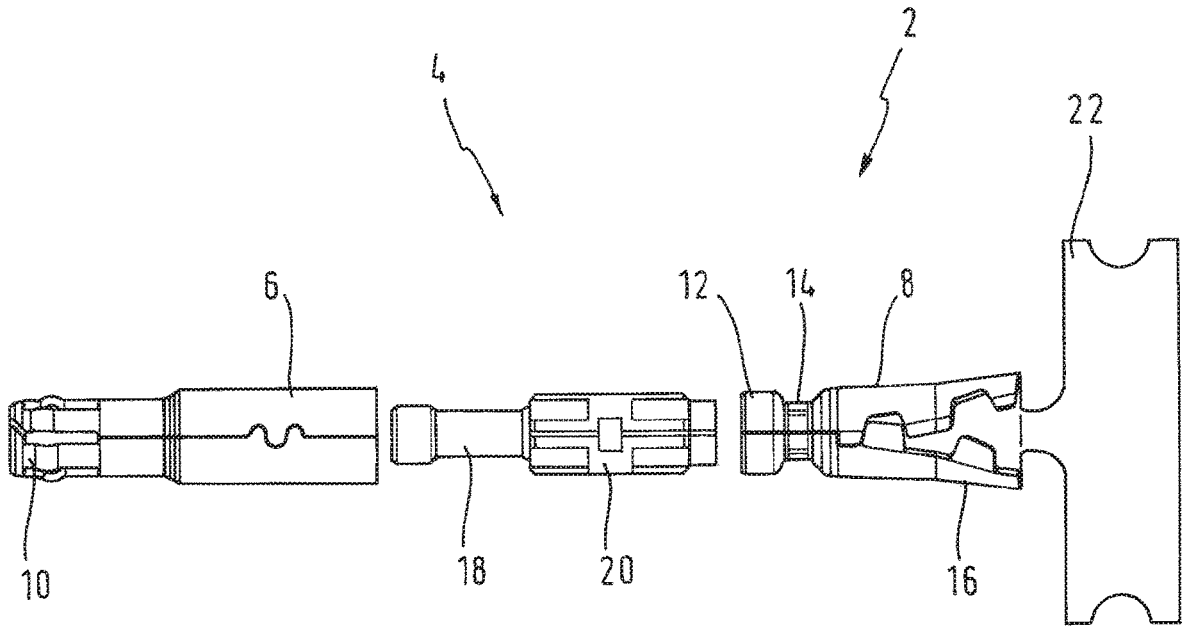
FIG. 1 shows a schematic exploded illustration of an outer conductor arrangement for a coaxial connector, consisting of a contact component and a connection component, according to one exemplary embodiment of the invention, in the unconnected state.

Reference is first made to FIG. 1.

An outer conductor arrangement 4 for a coaxial connector 2 for transmitting RF signals is illustrated.

In the present exemplary embodiment, the coaxial connector 2 is designed as an SMBA (FAKRA) connector according to standard DIN 72594-1 or OSCAR-18. In the present exemplary embodiment, the coaxial connector 2 is also designed as a plug and can be plugged into an appropriate mating connector (socket or coupler) of the coaxial connector 2. As a deviation from the present exemplary embodiment, the coaxial connector 2 can also be designed as a socket or coupler.

In addition to the outer conductor arrangement 4, a coaxial connector 2 of this kind has an inner conductor 18 around which the outer conductor arrangement 4 is arranged in a concentric arrangement in order to shield the inner conductor 18 against electromagnetic interference radiation. In the present exemplary embodiment, an electrical insulator 20 is arranged between the inner conductor 18 and the outer conductor arrangement 4.

In the present exemplary embodiment, the outer conductor arrangement 4 has a contact component 6 and a connection component 8.

In the present exemplary embodiment, the contact component 6 has a plug head 10 for plugging into a socket or coupling, while the connection component 8 is designed to link an outer conductor of a coaxial cable (not illustrated) to the outer conductor arrangement 4.

In the present exemplary embodiment, the contact component 6 has a hollow-cylindrical basic shape with the plug head 10 at a first end. At the other end of the contact component 6, which other end is opposite the first end, an opening is provided, through which opening the inner conductor 18 and the insulator 20 can be inserted into the inside of the contact component 6.

In the present exemplary embodiment, the connection component 8 has a contact section 12, an impedance matching section 14 and a connection section 16 in the joining direction toward the contact component 6.

The contact section 12 is designed for insertion into the inside of the contact component 6 and for connection to the inside face of the contact component 6 in order to form an outer conductor contact. The end-side end of the contact section 12 can in this case have the function of a bearing face, which interacts with a mating bearing face inside the contact component 6 in order to bring about axial positioning of the contact component 6 in relation to the connection component 8.

In the present exemplary embodiment, the impedance matching section 14 is a tube-shaped section of the connection component 8, which has an inside diameter and an outside diameter, which are each measured in such a way that, in the present exemplary embodiment, together with the inner conductor 18, a characteristic impedance of 50Ω is provided. The connection component 8 also has in the region of the impedance matching section 14 an outside diameter constricted portion, which can also have the function of a latching edge for forming a latching connection, using which the connection component 8 is connected to the contact component 6 in order to likewise bring about axial positioning of the contact component 6 in relation to the connection component 8.

The connection section 16 of the connection component 8 is designed to connect an outer electrical conductor of a coaxial cable by forming a crimp connection. The connection section 16 also has a tensile relief means 22 for mechanically fixing an insulation means of an outer conductor of a coaxial cable.

In the present exemplary embodiment, the contact component 6 and the connection component 8 are produced from brass or an alloy containing brass, from tin bronze or an alloy containing tin bronze, from zinc or an alloy containing zinc, or from stainless steel or an alloy containing stainless steel. In this case, in the present exemplary embodiment, the contact component 6 and the connection component 8 are produced from the same material. The outer conductor arrangement 4 comprising the contact component 6 and the connection component 8 can thus also be referred to as single-material. However, the materials from which the contact component 6 and the connection component 8 are produced have different thicknesses or material thicknesses and tensile strengths. The contact component 6 can thus be produced from a first material with a thickness and tensile strength that ensure particularly good electrical contact while the connection component 8 can thus be produced from a second material with a thickness and tensile strength that ensure particularly good mechanical contact.

In the present exemplary embodiment, the contact component 6 and the connection component 8 are each a stamped-and-bent component. Stamped-and-bent components are manufactured by virtue of them being stamped out of a metal sheet, for example, directly by the coil and being brought to their final shape by bending.

Figure 2:
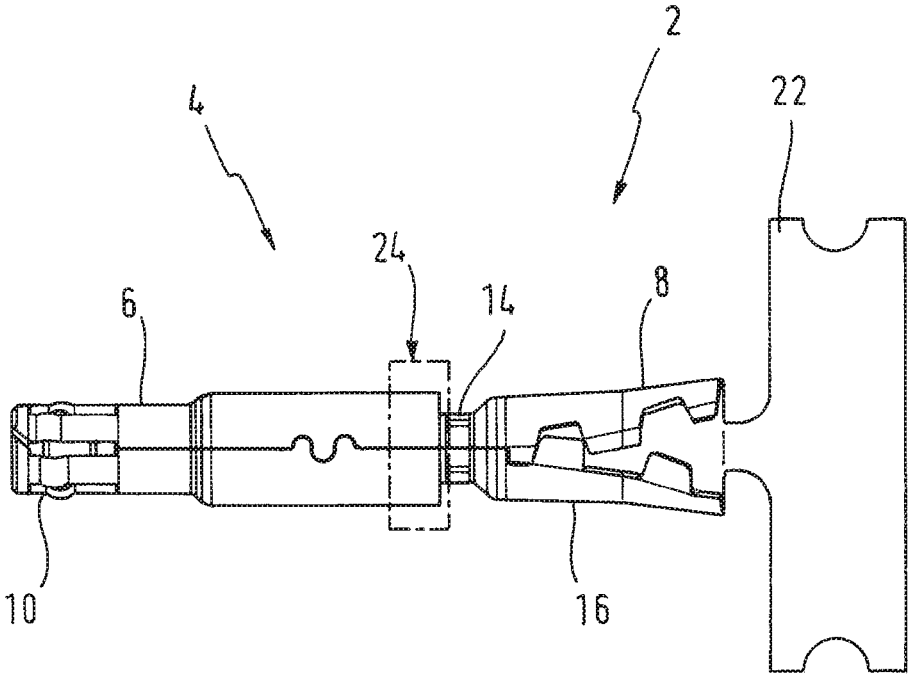
FIG. 2 shows the outer conductor arrangement illustrated in FIG. 1 for a coaxial connector in the connected state.

Reference is now also made to FIG. 2.

FIG. 2 shows the outer conductor arrangement 4 for a coaxial connector 2, wherein the contact component 6 is connected in materially bonded fashion to the connection component 8 in the present exemplary embodiment by a welding connection 24, after the inner conductor 18 and the insulator 20 have been inserted. In the present exemplary embodiment, therefore, in addition to the contact component 6 and the connection component 8, the welding connection 24 is also of single-material design.

Figure 3:
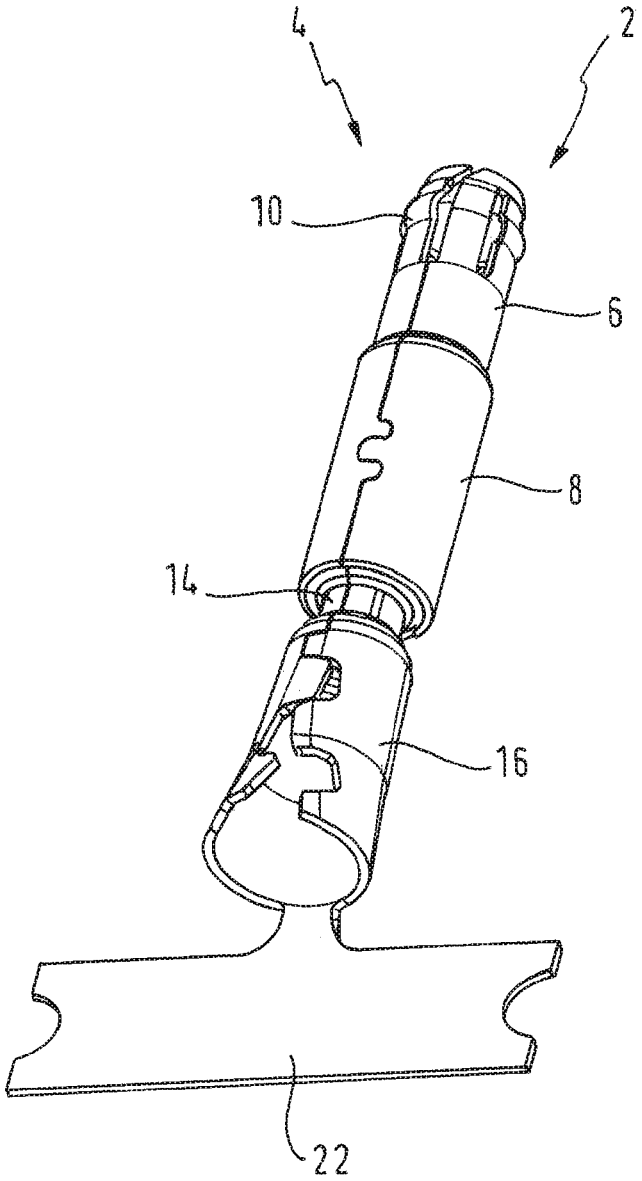
FIG. 3 shows a perspective illustration of the outer conductor arrangement illustrated in FIG. 2 for a coaxial connector.

Reference is now also made to FIG. 3.

FIG. 3 shows the fully assembled outer conductor arrangement 4 for linking to an outer conductor of a coaxial cable.

Figure 4:
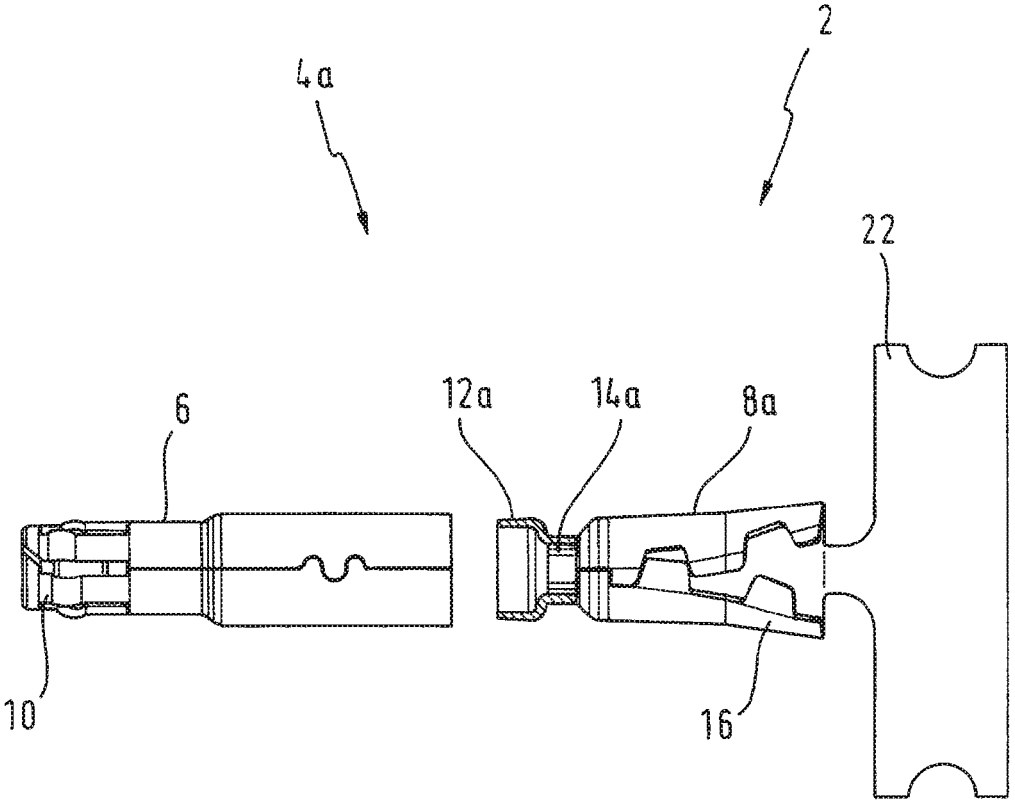
FIG. 4 shows a schematic exploded illustration of an outer conductor arrangement for a coaxial connector, consisting of a contact component and a connection component for linking an electrical line having a first diameter.
Figure 5:
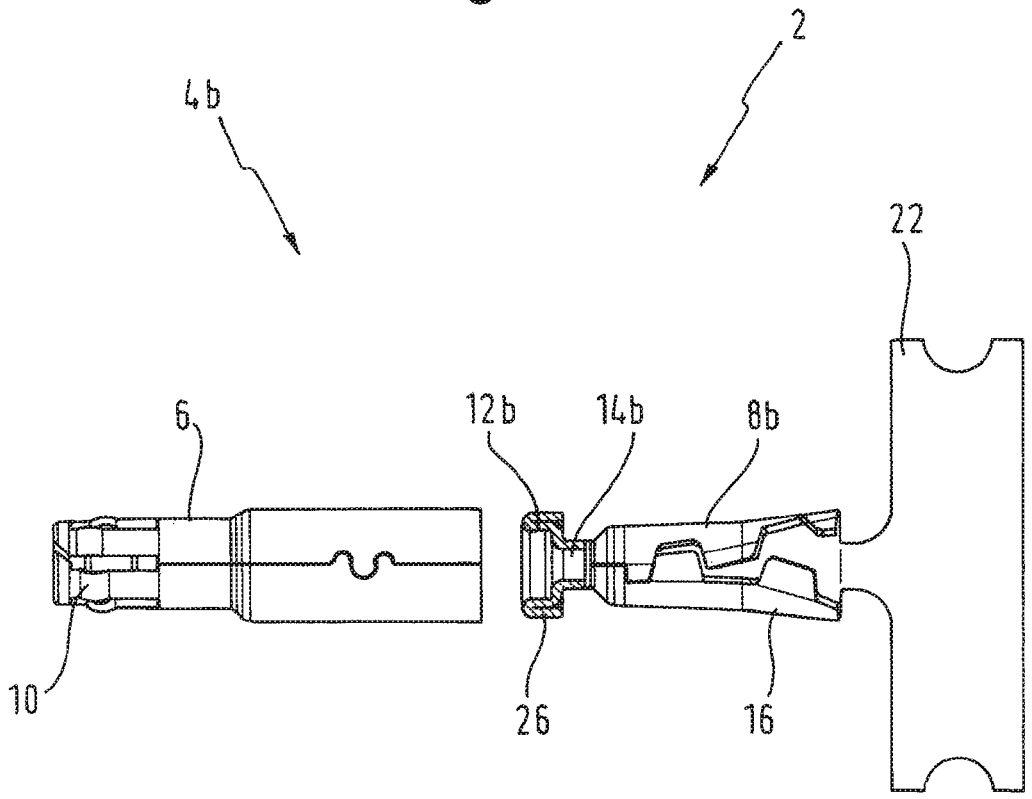
FIG. 5 shows a schematic exploded illustration of an outer conductor arrangement for a coaxial connector, consisting of a contact component and a connection component for linking an electrical line having a second, smaller diameter.
Figure 6:
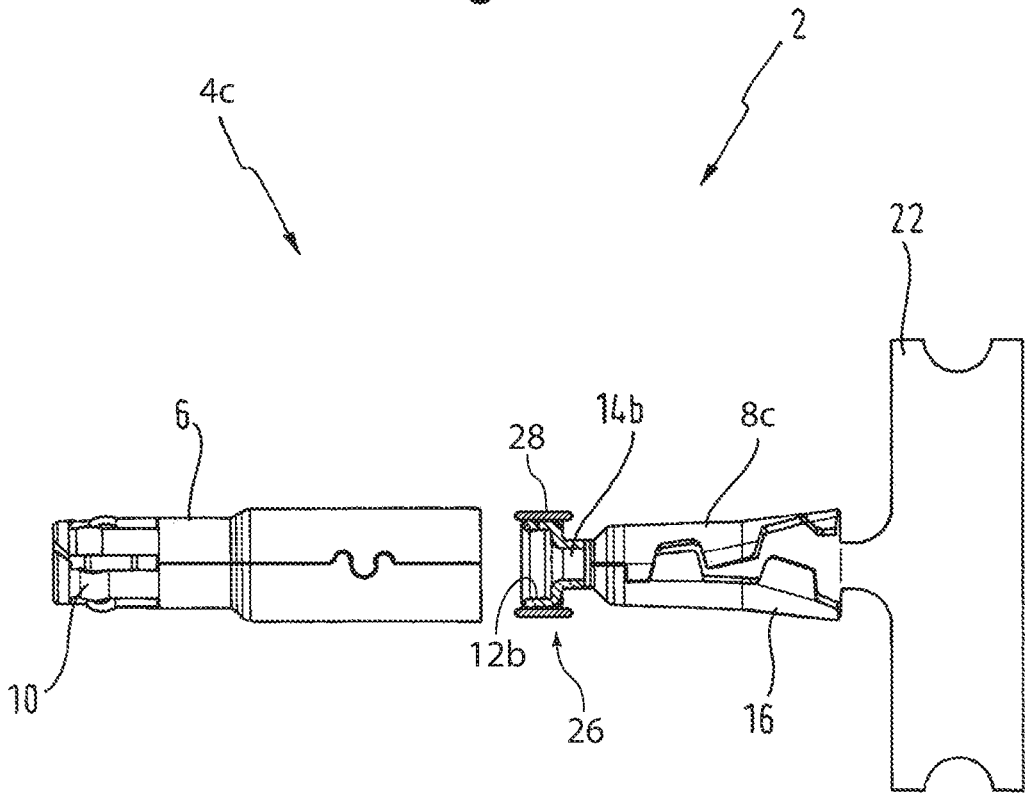
FIG. 6 shows a schematic exploded illustration of an outer conductor arrangement for a coaxial connector, consisting of a contact component and a connection component for linking an electrical line having a second, smaller diameter.

Reference is now also made to FIG. 4, FIG. 5 and FIG. 6, which show a construction kit for forming a coaxial connector 2.

FIG. 4 shows an outer conductor arrangement 4*a* for a coaxial connector 2 comprising a first connection component 8*a* for linking a coaxial cable having a first outer conductor diameter and a first inner conductor diameter. FIG. 5 shows an outer conductor arrangement 4*b* for a coaxial connector 2 comprising a second connection component 8*b* for linking a coaxial cable having a second outer conductor diameter, wherein the second diameters are smaller than the first diameters. FIG. 6 shows an outer conductor arrangement 4*c* for a coaxial connector 2 comprising a third connection component 8*c* for linking a coaxial cable having a second outer conductor diameter, wherein the second diameters are smaller than the first diameters.

The contact components 6 of the respective outer conductor arrangements 4*a*, 4*b*, 4*c* for coaxial connectors 2 are each of identical design. However, the first connection component 8*a*, the second connection component 8*b*, and the third connection component 8*c* are of different design. It can thus be seen with reference to FIGS. 4 and 5 that the first impedance matching section 14*a* of the outer conductor arrangement 4*a* for the first inner conductor diameter has a greater inside diameter and outside diameter than the second impedance matching section 14*b* of the outer conductor arrangements 4*b* for the second inner conductor diameter. This makes it possible to achieve a situation in which, in both cases, a prescribed characteristic impedance of 50Ω is provided since matching to the diameters of inner and outer conductors of the coaxial cable that is to be linked is effected by the respective inside diameter and outside diameter of the first impedance matching section 14*a* and of the second impedance matching section 14*b*.

FIG. 5 also shows that, in contrast to the first contact section 12*a* of the first connection component 8*a*, the second contact section 12*b* of the connection component 8*b* in the present exemplary embodiment has a compensation section 26, which is formed in the present exemplary embodiment by an edge that is folded in a simple manner. As an alternative, as shown in FIG. 6, the compensation section 26 can also be formed by an additional component, for example a ring 28, which is fitted onto the second contact section 12*b*.

The compensation section 26 in the present exemplary embodiment is formed by virtue of a sheet-metal section of the second contact section 12*b* being provided with a fold and being bent. In the present exemplary embodiment, the compensation section 26 is folded over once. In the present exemplary embodiment, the material thickness of the second contact section 12*b* is thus doubled. As an alternative, there may also be provision for the corresponding material section to be embossed before the folding in order to reduce the material thickness thereof. However, there may also be provision for multiple folding in order to multiply the material thickness accordingly.

The compensation section 26 results in the second contact section 12*b* of the connection component 8*b* having essentially the same outside diameter as the first contact section 12*a* of the first connection component 8*a* even though the inside diameters thereof are different. "Having essentially the same outside diameter" is understood in this case to mean that the outside diameter of the second contact section 12*b* of the second connection component 8*b* is in the range of production tolerances of the first contact section 12*a* of the first connection component 8*a*. In contrast, without the folded-over compensation section 26, the second contact section 12*b* of the second connection component 8*b* would have a reduced outside diameter due to the required smaller inside diameter, with the result that no sufficiently secure contact from the second contact section 12*b* of the second connection component 8*b* in the contact component 6 would be provided.

The different first impedance matching section 14*a* and the second impedance matching section 14*b* as well as the compensation section 26 thus permit the use of identically designed contact components 6, wherein coaxial cables having different outside diameters, outer conductor diameters and inner conductor diameters can be linked respectively to the first connection component 8*a* and the second connection component 8*b*.

Furthermore, this specification may be summarized as disclosing, inter cilia, the following embodiments:

Embodiment 1

An outer conductor arrangement (4) for a coaxial connector (2), characterized in that the outer conductor arrangement (4) is of two-part design, comprising a contact component (6) for electrical and mechanical connection to an outer conductor of a mating connector and comprising a connection component (8*b*) for electrical and mechanical connection to an outer conductor of a coaxial cable, wherein the contact component (6) and the connection component (8*b*) are electrically and mechanically connected to one another at a contact section (12*b*), wherein a compensation section (26) for compensation of a component difference in the region of the contact section (12*b*) is arranged between the contact component (6) and the connection component (8*b*).

Embodiment 2

The outer conductor arrangement (4) of Embodiment 1, characterized in that compensation section (26) is associated with the connection component (8*b*).

Embodiment 3

The outer conductor arrangement (4) of Embodiment 2, characterized in that the compensation section (26) is formed by a folded material section of the connection component (8*b*).

Embodiment 4

The outer conductor arrangement (4) of Embodiment 3, characterized in that the folded material section is embossed at least in sections.

Embodiment 5

The outer conductor arrangement (4) of any one of Embodiments 1 to 4, characterized in that the contact component (6) has a contact section (12*b*) having an outside diameter and the connection component (8*b*) has an inside diameter, wherein the compensation section (26) compensates for the component difference formed by the difference between the outside diameter of the contact section (12*b*) and the inside diameter of the connection component (8*b*).

Embodiment 6

The outer conductor arrangement (4) of any one of Embodiments 1 to 5, characterized in that the compensation section (26) is produced from brass or an alloy containing brass, from tin bronze or an alloy containing tin bronze, from zinc or an alloy containing zinc, or from stainless steel or an alloy containing stainless steel.

Embodiment 7

The outer conductor arrangement (4) of any one of Embodiments 1 to 6, characterized in that the connection component (8*b*) and the compensation section (26) are produced from the same material.

Embodiment 8

A contact component (6) for an outer conductor arrangement (4) of any one of Embodiments 1 to 7.

Embodiment 9

A connection component (8*b*) for an outer conductor arrangement (4) of any one of Embodiments 1 to 7.

Embodiment 10

A plug (28) for a coaxial connector (2) comprising an outer conductor arrangement (4) of any one of Embodiments 1 to 7.

Embodiment 11

A coaxial connector (2) comprising an outer conductor arrangement (4) of any one of Embodiments 1 to 7.

Embodiment 12

A construction kit for forming a coaxial connector (2) comprising an outer conductor arrangement (4) of any one of Embodiments 1 to 7, at least having a contact component (6), a first connection component (8*a*) and a second connection component (8*b*).

The invention claimed is:

1. A coaxial connector outer conductor assembly, comprising:

a first outer conductor component;

a second outer conductor component;

a ring, said second outer conductor component comprising a contact portion, a cable engagement portion, and an impedance adjustment portion intermediate said contact portion and said cable engagement portion, said first outer conductor component being electrically and mechanically coupled to said contact portion via said ring, and said impedance adjustment portion having an outer diameter that is substantially smaller than an outer diameter of said ring and is substantially smaller than an outer diameter of said cable engagement portion;

wherein said ring abuts said contact portion.

2. The coaxial connector outer conductor assembly of claim 1, wherein:

said first outer conductor component comprises a connector engagement portion electrically and mechanically coupleable to an outer conductor of a counterpart coaxial connector, and said cable engagement portion is electrically and mechanically coupleable to an outer conductor of a coaxial cable.

3. The coaxial connector outer conductor assembly of claim 1, wherein:

neither said impedance adjustment portion nor said cable engagement portion mechanically contacts said ring.

4. The coaxial connector outer conductor assembly of claim 1, wherein:

said in adjustment portion is longitudinally offset from said ring.

5. The coaxial connector outer conductor assembly of claim 1, wherein:

said second outer conductor component comprises an impedance adjustment portion that constitutes substantially an entirety of said second outer conductor component intermediate said cable engagement portion and said contact portion, and a maximum outer diameter of said impedance adjustment portion is substantially smaller than an outer diameter of said ring and is substantially smaller than an outer diameter of said cable engagement portion.

6. The coaxial connector outer conductor assembly of claim 1, wherein:

said first outer conductor component and said inner conductor collectively form a coaxial connector.

7. A coaxial connector assembly, comprising:

a first connector component;

a second connector component; and a ring, wherein said first connector component comprises a first end, a second end, a first outer conductor and a first inner conductor concentric to and electrically insulated from said first outer conductor, said first inner conductor and said first outer conductor form a coaxial plug connector at said first end, said second connector component is crimpable to a coaxial cable such that a stripped outer conductor of said cable mechanically and electrically contacts said second connector component and a stripped inner conductor of said cable is in electrical contact with said first inner conductor, and said second connector component electrically contacts said first outer conductor via said ring at said second end wherein said rile abuts a contact portion of said second connector component.

8. The coaxial connector assembly of claim 7, wherein:

said second connector component comprises a crimping portion, said contact portion and an impedance adjustment portion intermediate said crimping portion and said contact portion.

9. The coaxial connector assembly of claim 8, wherein:

said ring does not mechanically contact said crimping portion.

10. The coaxial connector assembly of claim 8, wherein:

a maximum outer diameter of said impedance adjustment portion is substantially smaller than an outer diameter of said ring and is substantially smaller than an outer diameter of said crimping portion.

11. The coaxial connector assembly of claim 8, wherein:

said impedance adjustment portion is adjacent said contact portion and adjacent said crimping portion.

12. An assembly, comprising:

a first outer conductor component;

a second outer conductor component;

an inner conductor component arranged concentric to and inward of said first outer conductor component;

an insulator that electrically insulates said inner conductor component from said first outer conductor component; and a ring, said second outer conductor component comprising a contact portion, and said first outer conductor component being electrically and mechanically coupled to said contact portion via said ring;

wherein said ring abuts said contact portion.

13. The assembly of claim 1, wherein:

said first outer conductor component comprises a connector engagement portion electrically and mechanically coupleable to an outer conductor of a counterpart coaxial connector, and said second outer conductor component comprises a cable engagement portion electrically and mechanically coupleable to an outer conductor of a coaxial cable.

14. The assembly of claim 13, wherein:

said second outer conductor component comprises an impedance adjustment portion intermediate said contact portion and said cable engagement portion, said impedance adjustment portion having an outer diameter that is substantially smaller than an outer diameter of said ring and is substantially smaller than an outer diameter of said cable engagement portion.

15. The assembly of claim 14, wherein:

neither said impedance adjustment portion nor said cable engagement portion mechanically contacts said ring.

16. The assembly of claim 14, wherein:

said impedance adjustment portion is longitudinally offset from said ring.

17. The assembly of claim 12, wherein:

said second outer conductor component comprises an impedance adjustment portion that constitutes substantially an entirety of said second outer conductor component intermediate said cable engagement portion and said contact portion, and a maximum outer diameter of said impedance adjustment portion is substantially smaller than an outer diameter of said ring and is substantially smaller than an outer diameter of said cable engagement portion.

18. The assembly of claim 12, wherein:

said first outer conductor component and said inner conductor collectively form a coaxial connector.

* * * * *